United States Patent [19]

Brockwell et al.

[11] Patent Number: 4,744,203

[45] Date of Patent: May 17, 1988

[54] MACHINE FOR VACUUM-SEALING A PACKAGE

[75] Inventors: Ian P. Brockwell, Edina, Minn.; Andrew M. Lockyer, Norton-Sub-Hamdon, England

[73] Assignee: Alfa-Laval Cheese Systems Limited, Somerset, England

[21] Appl. No.: 24,018

[22] Filed: Mar. 10, 1987

[51] Int. Cl.[4] ..... B65B 31/00

[52] U.S. Cl. ..... 53/512; 53/373; 53/86

[58] Field of Search ..... 53/86, 510, 89, 511, 53/95, 512, 96, 373

[56] References Cited

U.S. PATENT DOCUMENTS

| | | | |
|---|---|---|---|
| 3,501,888 | 3/1970 | Egli et al. | 53/86 |
| 3,511,021 | 5/1970 | Lyon et al. | 53/86 X |
| 3,958,391 | 5/1976 | Kujubu | 53/95 X |
| 4,103,471 | 8/1978 | Lowdermilk | 53/512 X |
| 4,221,101 | 9/1980 | Woods | 53/512 X |
| 4,580,393 | 4/1986 | Furukawa | 53/512 |
| 4,586,320 | 5/1986 | Takai et al. | 53/373 X |

*Primary Examiner*—Robert L. Spruill
*Assistant Examiner*—Steven P. Weihrouch
*Attorney, Agent, or Firm*—Davis, Hoxie, Faithfull & Hapgood

[57] ABSTRACT

A machine for vacuum-sealing a block of cheese in a tube of heat-sealable plastics material forming the lining of a cheese box mounted on a wheeled dolly, the tubular lining having an open end which projects out of the cheese box. The machine comprises a frame having an upright wall fitted with transverse rails for supporting the dolly carrying the cheese box, a hollow casing open at one end and mounted on the frame for movement between an open position permitting movement of the dolly and cheese box onto the rails and a closed position in which the casing cooperates with the wall to form a chamber enclosing the rails, dolly and cheese box, and means for evacuating air from the chamber. The machine also has gripper mechanism for holding taut the open end of the lining tube, and welding mechanism for sealing the open end of the tube when the chamber is evacuated, the gripper and welding mechanisms being enclosed within the chamber.

3 Claims, 4 Drawing Sheets

FIG. 4
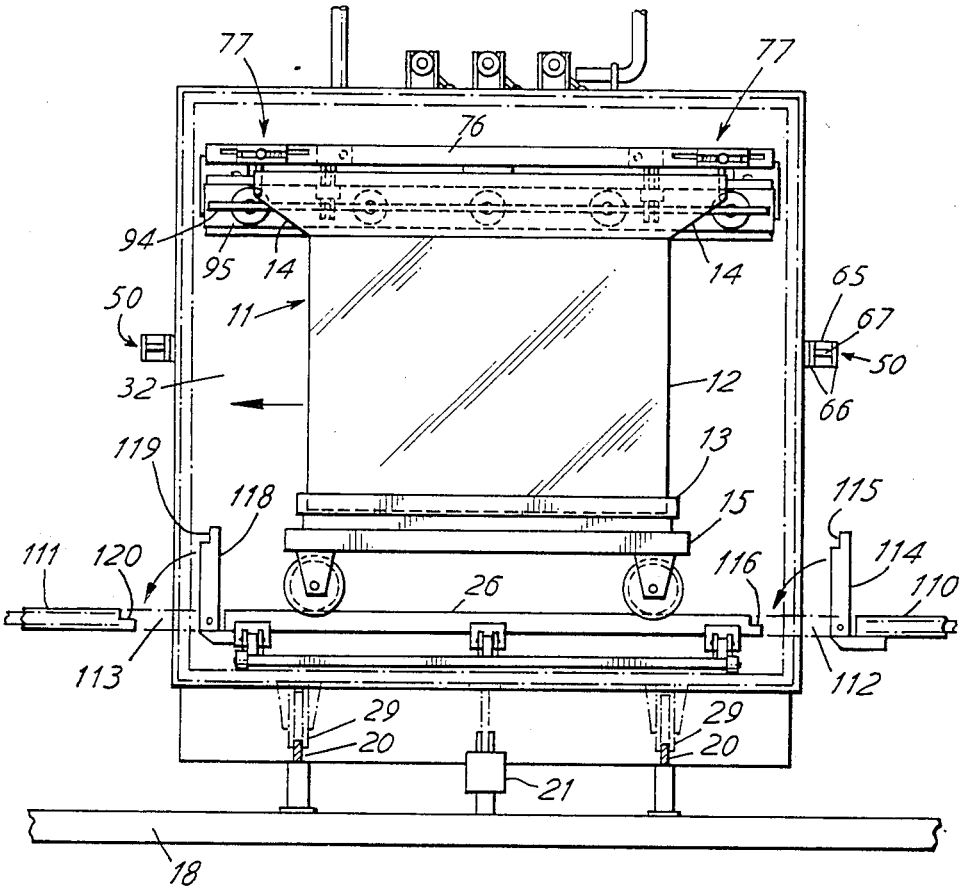
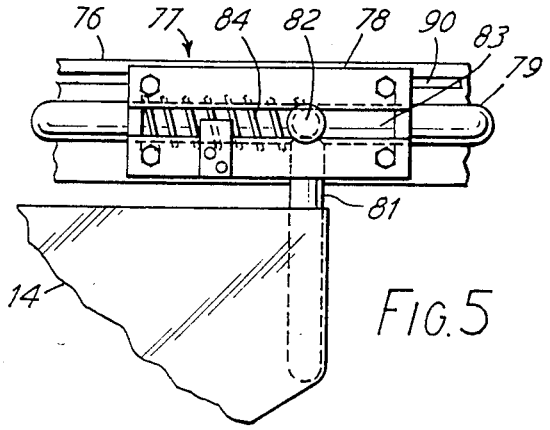
FIG. 5

MACHINE FOR VACUUM-SEALING A PACKAGE

This invention relates to a machine for vacuum-sealing a package formed of a product in an envelope of heat sealable plastics material.

It is known to provide machines for this purpose which comprise a conveyor for feeding the product onto a platform, a cover pivotally connected to one side of the platform and movable into a closed position in which the cover co-operates with the platform to form a vacuum chamber, and welding means inside the chamber for heat sealing the envelope of the package while the chamber is under vacuum. The known machines are however only suitable for use with small and medium sized packages which can easily be transported by conveyor.

The object of the invention is to provide an improved construction of vacuum-sealing machine suitable for use with large packages.

According to the present invention there is provided a machine for vacuum-sealing a package formed of a product in an envelope of heat-sealable plastics material, the envelope being open at one end thereof, the machine comprising a frame providing an upright wall having a sealing surface thereon, a hollow casing mounted on the frame for movement towards and away from the sealing surface on the wall, the casing being open at the end facing said wall and the casing being movable between an open position in which the casing is spaced from the wall and a closed position in which the open end of the casing abuts the sealing surface on the wall and co-operates therewith to define a closed chamber, latch means operable to clamp the casing to the wall to provide an air-tight seal therebetween, support means mounted on the wall for support of the package, the support means and package being accommodated within the chamber when the casing is in the closed position, gripper mechanism mounted on the wall for holding open the open end of the envelope, first welding mechanism mounted on said wall, second welding mechanism mounted on the casing in the interior thereof and adapted to co-operate with the first welding mechanism to seal the open end of the envelope, said gripper mechanism and said first welding mechanism being mounted on a part of the wall which is surrounded by said sealing surface, and control valve means mounted on the wall and operable selectively to connect the chamber to a source of vacuum or to atmosphere.

The machine of the invention is particularly suitable for vacuum-sealing a cheese box filled with a large block of cheese, for example a 640 lb block of cheese, the cheese box being provided with a lining of heat-sealable plastics material having an open-end which projects out of the cheese box. A cheese box of this size is preferably mounted on a wheeled dolly. In the machine of the invention, the support means then preferably comprises transverse rails mounted on a cantilever structure on the wall, the cantilever structure being mounted on a part of the wall which is surrounded by the sealing surface, and the transverse rails being aligned with further rails for rolling the dolly and cheese box onto and off the transverse rails when the casing is in the open position.

One construction of a vacuum sealing machine according to the invention will now be described, by way of example, with reference to the accompanying drawings, in which:

FIG. 4 is an elevation view of the rear of the front wall of the machine, with a container in position for sealing, and FIG. 5 is an elevation view on a larger scale of part of the gripper mechanism in the machine.

Figure 1:
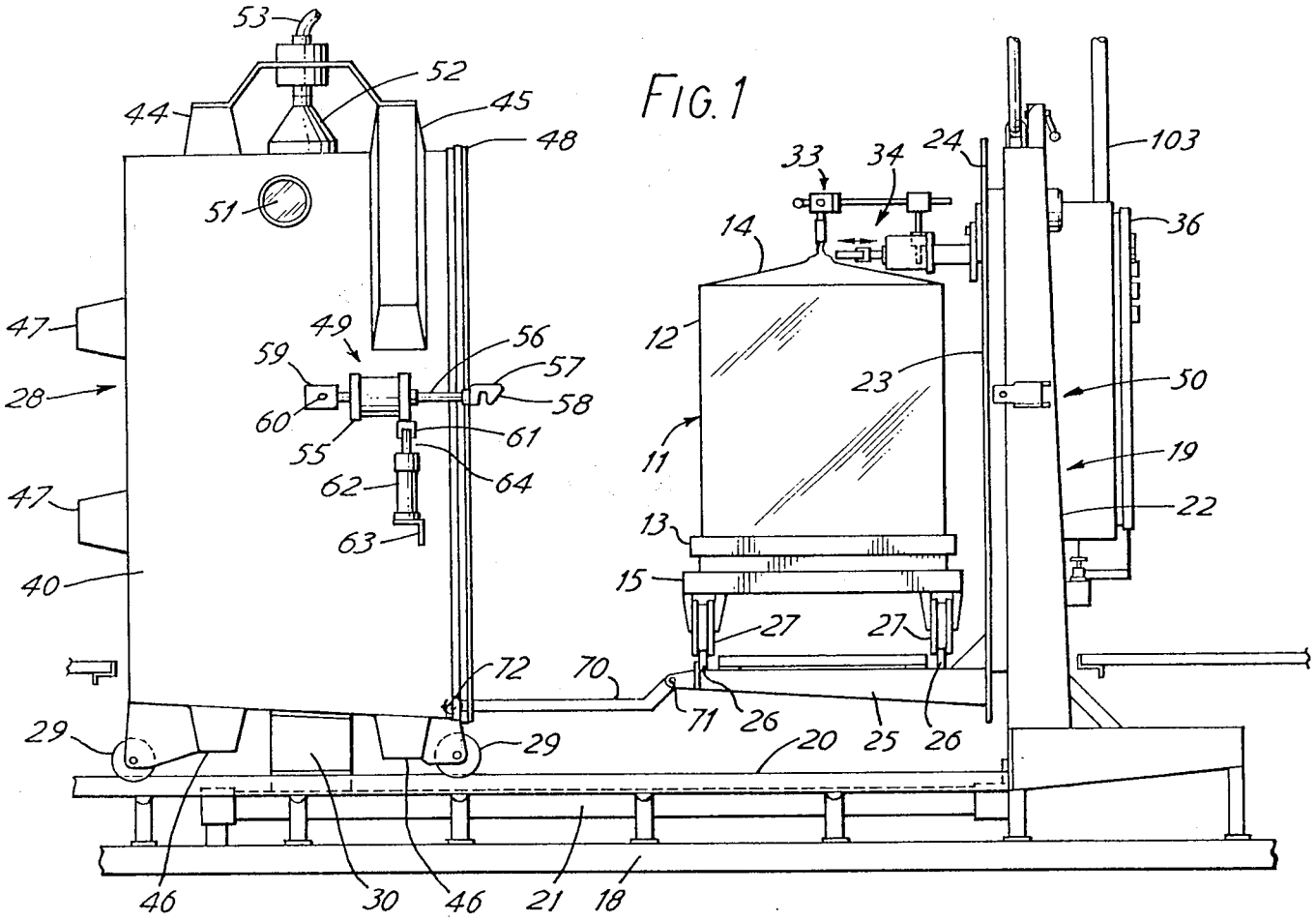
FIG. 1 is a side elevation view of the machine in the open position.

The machine shown in the drawings is for use in vacuum sealing an open end of an envelope of heat-sealable plastics sheet material which forms a lining of a cheese box 11 filled with a block of cheese, the plastics sheet material being substantially impervious to air and moisture. The cheese box 11 comprises a rigid open-ended container tube 12 of rectangular cross section and an end cap 13 fitted to an end of the container tube. The envelope of plastics material is in the form of an open-ended tube 14 having cross sectional dimensions substantially equal to those of the interior of the container tube 12, and a length substantially greater than that of the container tube 12. The cheese box is filled with the cheese by first mounting the container tube 12 in an upright position, fitting the plastics tube 14 in the container tube 12 with the ends of the plastics tube projecting from the ends of the container tube, depositing the block of cheese in the lined container tube with the weight of the cheese supported on an elevator platform at the lower end of the container, closing the upper end of the plastics tube, fitting the end cap 13 on the upper end of the container tube 12, inverting the cheese box filled with the cheese, and mounting the cheese box in an upright position on a wheeled dolly 15. The lower end of the cheese box is then closed by the end cap 13, and the upper end of the plastics tube 14 is open and projects from the upper end of the cheese box, as shown in FIG. 1 of the drawings.

The vacuum sealing machine comprises a frame 18 supporting a front wall 19, a pair of parallel rails 20 extending rearwardly from the front wall, and a pneumatic cylinder unit 21 positioned between and parallel to the rails 20. The front wall 19 comprises an upright rigid framework 22 fitted at the rear thereof with a rigid upright transverse plate 23. The outer margins of the rear face of the plate 23 provide a sealing surface 24 for a purpose described hereinafter. Cantilever beams 25 are welded to the rear face of the plate 23 within the outer margins thereof, and a pair of parallel rails 26 are mounted on the beams 25, the rails 26 extending transversely across the rear face of the plate 23. The rails 26 are adapted to support the wheeled dolly 15 carrying the cheese box 11, the dolly 15 having wheels 27 which run on the rails 26. A large outer casing 28 is fitted with wheels 29 which run on the rails 20, the casing being connected by a coupling 30 to a piston (not shown) of the cylinder unit 21. The casing 28 is open at the front end thereof, and the cylinder unit 21 is operable to move the casing between an open rear position shown in FIG. 1 and a closed forwards position shown in FIG. 2. In its forwards position, the casing abuts against the sealing surface 24 on the upright transverse plate 23 and co-operates with the plate to define a closed chamber 32 (FIG. 2) of a size to accommodate the cantilever beams 25, the dolly 15 and the cheese box 11. The rear face of the plate 23 is fitted with brackets which support gripper mechanism 33 (FIG. 1) for holding open the upper end of the plastics tube 14 forming the lining of the cheese box, and welding mechanism 34 adapted to cooperate with welding mechanism 35 (FIG. 2) fitted inside the casing 28 to seal the open end of the plastics lining tube. The front wall 19 is fitted at the front end thereof with a control box 36 containing switches for operating the machine.

The outer casing 28 comprises two side walls 40, a rear wall 41, a flat roof 42, and a floor 43 which slopes downwards towards the open front of the casing for drainage purposes. The roof 42 is reinforced by hollow transverse ribs 44, 45 welded to the external surface of the roof, the ribs 45 also extending partly down the side walls for reinforcement of the side walls, the floor is reinforced by hollow transverse ribs 46, welded to the underside of the floor, and the rear wall is reinforced by horizontal hollow ribs 47 welded to the external surface of the rear wall. The side walls are also provided with vertical hollow ribs (not shown) welded to the inside surface thereof. A rubber strip 48 is fitted to the front edges of the side walls 40, roof 42 and floor 43, the rubber strip extending around the full periphery of the open end of the casing and arranged to provide an airtight seal between the casing and the sealing surface 24 on the front wall of the frame when the casing is in its forwards position. Two pneumatic latches 49 are fitted on the casing 28, one on each of the side walls 40 thereof, and each latch is adapted to engage with an anchor 50 on the associated side of the front wall of the frame. Each side wall 40 is also provided with a sight glass 51. The roof 42 is provided with a housing 52 which accommodates an electric light and also provides an entry for an electric cable 53 for supplying electric power to the welding mechanism 35.

Each latch 49 comprises a pneumatic cylinder 55 having a piston rod 56 fitted with a hook 57. The cylinder 55 is arranged in a substantially horizontal position with the piston rod projecting to the front of the casing 28 and the open side of the hook 57 facing downwards. The front edge 58 of the hook is inclined downwards and rearwards for a purpose explained hereinafter. The rear end of the cylinder 55 is pivotally mounted to a bracket 59 on the associated side of the casing for angular movement about a horizontal transverse axis 60, and the front end of the cylinder 55 rests on a bracket 61 on the side wall of the casing. An upright cylinder 62 is mounted on another bracket 63 below the front end of cylinder 55, the cylinder 62 being arranged so that its piston rod 64 engages the cylinder 55 upon extension of the piston rod from its cylinder. Extension and retraction of the piston rod 64 in its cylinder 62 thus causes upward and downward pivotal movement respectively of the cylinder about the axis 60.

Each anchor 50 comprises a bracket 65 (FIG. 4) welded to the associated side of the front wall of the frame, the bracket 65 having two vertical plates 66 spaced apart and arranged parallel to the fore and aft axis of the machine and a horizontal transverse bar 67 extending between the rear end portions of the plates 66 with its ends secured in apertures in the plates 66. The anchor is arranged so that, when the casing 28 is moved by its cylinder 21 into its forwards position with the piston rod 56 in the extended position, the inclined front edge 58 of the hook 57 engages the bar 67 and causes the cylinder 55 to pivot upwards about the axis 60. The hook 57 on the end of the piston rod 56 rides up the bar 67 and, when the bar is below the open side of the hook, the cylinder 55 pivots downwards under its own weight to engage the hook with the bar.

Figure 2:
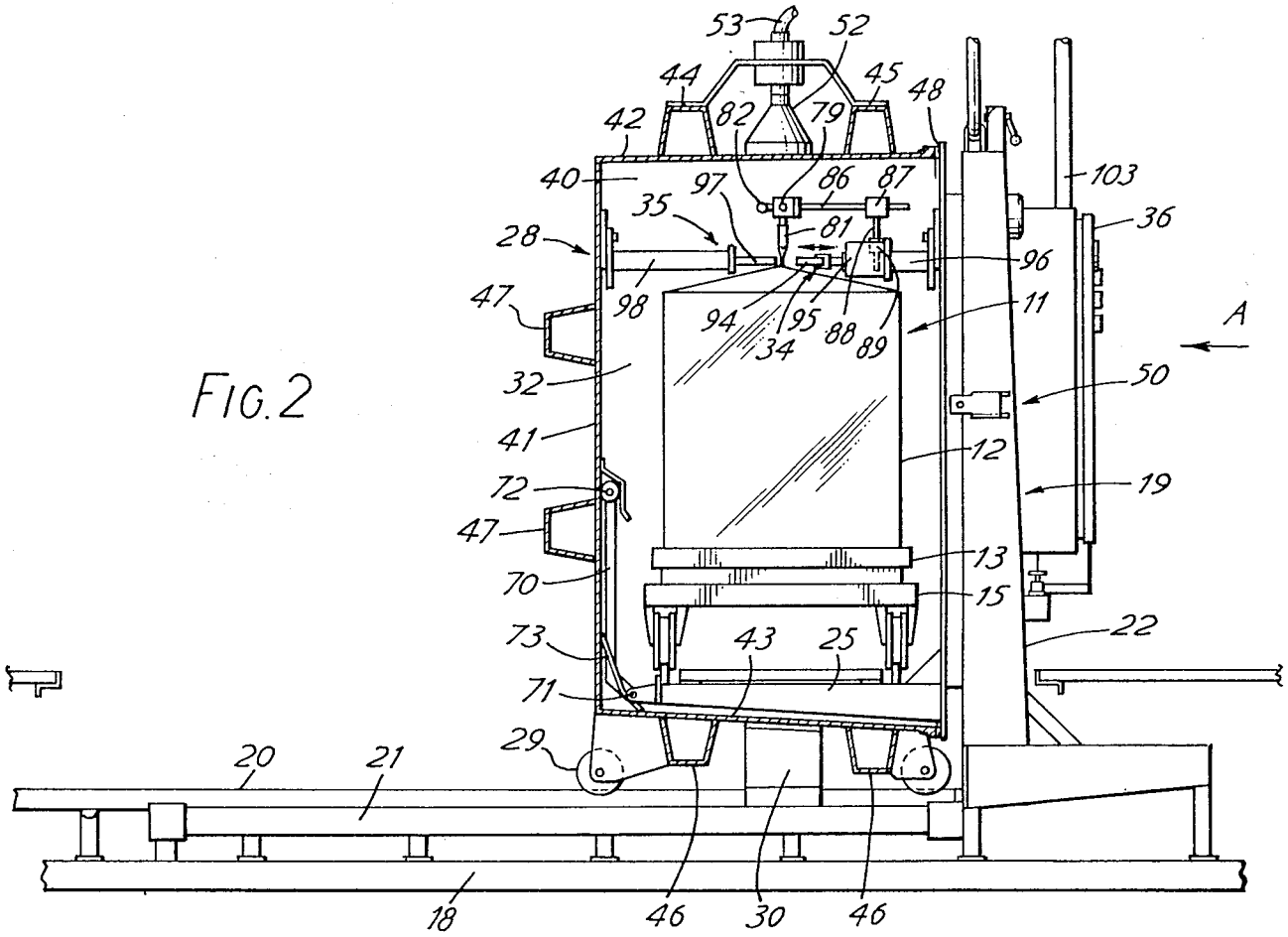
FIG. 2 is a side elevation view of the machine in the closed position, with the outer casing shown in section to illustrate the interior of the casing.

A walkway 70 is provided between the cantilever beams 25 on the front wall of the frame and the casing 28 when in its rear position. The walkway comprises a substantially rectangular platform structure having one side thereof pivotally connected to the rear ends of the beams 25 for angular movement about a horizontal transverse axis 71. The other side edge of the walkway 70 is provided with rollers 72 which rest on the floor of the casing. The rollers 72 are arranged to run along the floor of the casing when the casing is moved forwards from its rear position. As shown in FIG. 2, the rear end of the floor of the casing is provided with a ramp 73 arranged so that the rollers 72 roll up the ramp and onto the rear wall of the casing, thereby pivoting the walkway upwards about the axis 71, upon movement of the casing into its forwards position. The walkway is cranked upwards adjacent the side thereof which is pivotally connected to the beams 25 so that, in the fully forwards position of the casing, the walkway lies along the rear wall of the casing without interference between the rear ends of the beams and the ramp. The rear wall of the casing is provided with a bracket 74 arranged to hold the rollers in contact with the rear wall of the casing, and thereby prevent the walkway falling forwards over the beams 25 when the casing is in its forwards position.

The gripper mechanism 33 comprises a horizontal support bar 76 (FIG. 4) and two spring devices 77 mounted on the bar one adjacent each end thereof. Each spring device comprises a rectangular section tube 78 (FIG. 5) extending parallel to the bar 76, the ends of the tube being closed except for a central aperture, a central rod 79 mounted as a close sliding fit in the central apertures in the closed ends of the tube 78, the rod 79 being fitted with a pin 81 projecting downwards through a longitudinal slot in the underside of the tube 78 and with another pin 82 projecting horizontally rearwards through a longitudinal slot 83 in the rear wall of the tube, and a coil spring 84 surrounding the rod 79 and compressed between the end of the tube 78 facing towards the centre of the machine and the pins 81, 82. The springs in the two devices thus urge the rods 79 together with their pins 81, 82 away from each other. The support bar 76 is mounted on the rear ends of horizontal rods 86 (FIG. 2) arranged parallel to the fore and aft axis of the machine and adjustably secured in apertures in support blocks 87 which are in turn mounted on the upper ends of vertical rods 88 adjustably secured in further support blocks 89 mounted on the plate 23. The support bar 76 is adjusted, by adjustment of the rods and blocks 86–89, to a position in which it lies in a vertical plane midway between the transverse rails 26. The tubes 78 of the spring devices are adjustably mounted on the support bar 76 by bolts which extend through longitudinal slots 90 in the bar 76, so that the spacing between the spring devices 77 can be adjusted as desired to grip the open end of a lining tube in a cheese box.

The welding mechanism 34 comprises a horizontal welding bar 94 and a plurality of pneumatic cylinders 95 mounted on supports 96 spaced across and secured to the rear face of the plate 23, the bar 94 being secured to the rear ends of the piston rods of the cylinders 95. The welding mechanism 35 comprises a horizontal welding bar 97 mounted on supports 98 spaced across and secured to the rear wall of the casing in the interior thereof. The two mechanisms 34, 35 are arranged so that, when the casing 28 is in its forwards position, the welding bars 94, 97 are opposite one another below the spring devices 77 of the gripper mechanism, and the cylinders 95 are operable to compress therebetween a lining tube 14 in the gripper mechanism.

Figure 3:
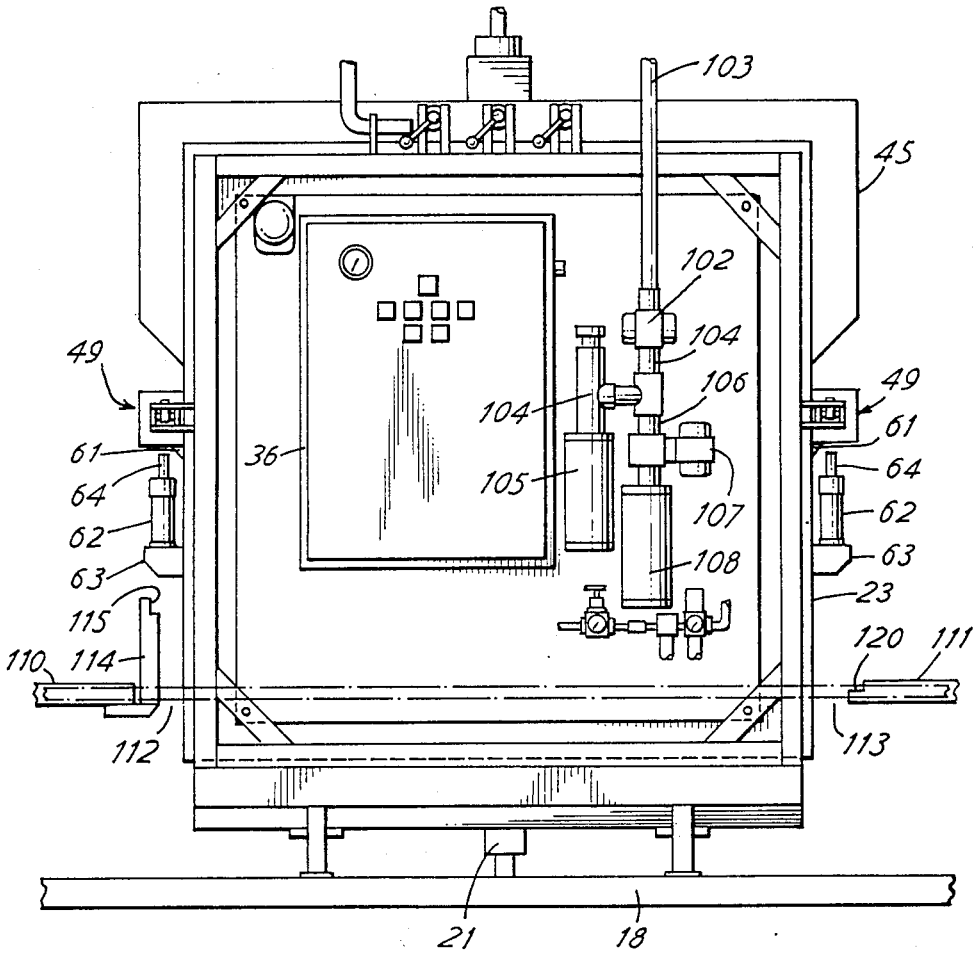
FIG. 3 is an elevation view of the front of the machine, that is, in the direction of the arrow A in FIG. 2.

The front wall 19 of the machine is fitted with a control valve 102 (FIG. 3) operable to connect a port (not shown) in the front wall to either a conduit 103 connected to a source of vacuum or to a conduit 104 connected to atmosphere. The port in the front wall also extends through the plate 23 and opens into the chamber 32 formed by the plate 23 and the cover 28 when the cover is in the forwards position. The conduit 104 is fitted with a filter 105 which restricts the rate of inflow of air into the conduit. A further conduit 106 fitted with a control valve 107 and a filter 108 opens into the conduit 104.

The pair of transverse rails 26 for supporting the wheeled dolly 15 carrying the cheese box are aligned with a pair of rails 110 on the right of the machine as shown in FIG. 4 for movement of a wheeled dolly and cheese box to be vacuum-sealed onto the machine, and the pair of rails 26 are also aligned with another pair of rails 111 on the left of the machine as shown in FIG. 4 for movement of a wheeled dolly and a cheese box out of the machine after being vacuum-sealed. A gap 112 is provided between the rails 110 and the rails 26 and a gap 113 is provided between the rails 111 and the rails 26 to accommodate the side walls of the casing 28 when in its forwards position. Two rail sections 114 of a length to bridge the gap 112 are hinged to the ends of the rails 110 and urged by a spring (not shown) into an upright position as shown in FIG. 4. The free end of each rail section 114 is formed with a step 115 adapted to engage a complementary step 116 on the associated rail 26 when the rail sections are pivoted into a horizontal position in order to support the rail sections during passage of a wheeled dolly and cheese box from the rails 110 onto the rails 26. As shown in FIG. 4, two further rail sections 118 of a length to bridge the gap 113 are hinged to the associated ends of the rails 26 and urged by a spring (not shown) into an upright position. The free end of each rail section 118 is formed with a step 119 adapted to engage a complementary step 120 on the associated rail 111 when the rail sections are pivoted into a horizontal position in order to support the rail sections during passage of a wheeled dolly and cheese box from the rails 26 onto the rails 111.

An operational cycle of the machine for vacuum-sealing the open end of a heat-sealable plastics tube 14 forming the lining of a cheese box 11 on a wheeled dolly 15 will now be described. At the start of the cycle, the casing 28 is in its rear position with the walkway 70 extending between the beams 25 and the casing as shown in FIG. 1, the hooks 57 on the latches 49 are in their fully extended position, and the dolly with the cheese box is mounted on the rails 110. The dolly carrying the cheese box is then rolled along the rails 110 and onto the rails 26 on the machine, the wheels of the dolly engaging against the rail sections 114 and pivoting the rails sections into the horizontal position during passage of the wheels cross the gap 112. When the wheels have passed over the gap 112, the rail sections 114 are returned by their springs into the upright position shown in FIG. 4. The dolly carrying the cheese box is positioned midway along the rails 26, and the open end of the lining tube 14 is mounted on the gripper mechanism by moving the rods 79 of the spring devices towards one another against the action of their springs, positioning the open end of the lining tube around the pins 81 on the rods 79, and then releasing the rods 79 so that the pins 81 are urged by the springs away from one another and hold the open end of the tube taut as shown in FIG. 4. This can be done by an operator standing on the walkway 70 and moving the rods 79 of the spring devices by grasping the pins 82 on the rods 79.

When the lining tube is in position on the pins 81, the casing 28 is moved by the cylinder unit 21 into its forwards position in which the rubber strip 48 engages against the sealing surface 24 on the plate 23. During this movement the inclined front edges 58 of the hooks 57 on the latches 49 engage against the associated anchor bars 67 and cause the latches to pivot upwardly about the axes 60. When the open faces of the hooks 57 are above the anchor bars 67, the latches 49 pivot downwards under their own weight to engage the hooks 57 fully with the anchor bars 67. The cylinders 55 of the latches are then operated to retract the hooks 57 engaged with the anchor bars 67 and thereby clamp the casing against the plate 23 with the rubber strip 48 providing an air-tight seal against the sealing surface 24. Air is then evacuated from the chamber 32 by actuating the valves 102, 107 to close the conduit 104 to atmosphere and connect the vacuum conduit 103 to the chamber 32. When a high vacuum is obtained in the chamber 32, the cylinders 95 of the welding mechanism 34 are operated to clamp the open end of the lining tube between the welding bars 94, 97 and an electric welding current is then applied to the welding bars. Before welding the lining tube 14, it is advisable for the operator to inspect the lining tube through the sight glass 51 by the illumination provided by the lamp in the housing 52 to check that the lining tube has not been dislodged from the gripper pins 81 by the air evacuated from the chamber and from the interior of the cheese box.

When the welding operation is completed, the cylinders 95 are operated to withdraw the welding bar 94 from the welding bar 97, and the valve 102 is actuated to close the vacuum conduit 103 and connect the chamber 32 to atmosphere through the conduit 104. Upon entry of some air into the chamber 32, the air pressure therein draws the sealed end of the lining tube 14 off the pins 81 and forces the lining tube flat against the top of the cheese block. The valve 107 is then actuated to open the conduit 106 to atmosphere and thereby increase the rate of supply of air to the chamber. This procedure reduces the risk of damage to the lining tube by the rush of air into the chamber if both the conduits 104 and 106 were connected to the chamber 32 while the lining tube was still mounted on the pins 81.

When the chamber 32 is at atmospheric pressure, the cylinder 55 of each latch 49 is actuated to extend the piston rod 57, and the cylinder 62 is actuated to pivot the cylinder 55 upwardly about its axis 60 and thereby release the hook 57 from the anchor bar 67. The casing is then moved into its rear position by the cylinder 21, and the dolly 15 carrying the cheese box rolled along the rails 26 and onto the rails 11, the wheels of the dolly engaging against the rail sections 118 and pivoting the rail sections into the horizontal position during passage of the wheels across the gap 113. The upper end of the cheese box is then closed by another end cap 13.

In a case in which the lower end of the lining tube is only folded and not sealed prior to the fitting of the first end cap 13 as explained above, the cheese box may be again inverted with the sealed end of the cheese box mounted on the dolly, the upper end of the lining tube unfolded, and the dolly and cheese box passed through the machine again to seal the lining tube.

We claim:

1. A machine for vacuum-sealing a mass of cheese in an envelope of heat sealable plastics material which forms an internal lining in a cheese box mounted on a wheeled dolly, the envelope having an open end which projects out of the upper end of the cheese box, the machine comprising a frame providing an upright wall having a sealing surface thereon, a hollow casing mounted on the frame for movement towards and away from said sealing surface on the wall, the casing being open at the end facing said wall and the casing being movable between an open position in which the casing is spaced from the wall and a closed position in which the open end of the casing abuts the sealing surface on the wall and cooperates therewith to define a closed chamber, latch means operable to clamp the casing to the wall to provide an air tight seal therebetween, support means mounted on said wall for support of the wheeled dolly and cheese box, the support means, wheeled dolly and cheese box being accommodated within the chamber when the casing is in the closed position, gripper mechanism mounted on the wall for holding the open end of the envelope, first welding mechanism mounted on said wall, second welding mechanism mounted on the casing in the interior thereof and adapted to cooperate with the first welding mechanism to seal the open end of the envelope, said gripper mechanism and said first welding mechanism being mounted on a part of the wall which is surrounded by said sealing surface, and control valve means operable selectively to connect the chamber to a source of vacuum or to atmosphere, wherein said support means comprises a cantilever structure mounted on a part of the wall which is surrounded by said sealing surface and transverse rails mounted on the cantilever structure, the transverse rails being adapted to support the wheeled dolly with the wheels thereof in rolling engagement with the transverse rails, and further rails are aligned with said transverse rails for rolling the dolly and cheese box onto and off said transverse rails when the casing is in the open position, said further rails comprising a first set of rails spaced by a gap from one end of the transverse rails, a second set of rails spaced by a gap from the other end of the transverse rails, a first set of rail sections adapted to bridge the gap between the first set of rails and the transverse rails, and a second set of rail sections adapted to bridge the gap between the transverse rails and the second set of rails, said rail sections being movable into a disengaged position permitting passage of the casing through said gaps during movement of the casing into its closed position.

2. A machine as claimed in claim 1, wherein the first set of rail sections are pivotally mounted on the ends of the first set of rails adjacent the transverse rails and urged by spring means into an upright position, the first set of rail sections being movable by contact with the wheels of the dolly into a horizontal position bridging the gap between the first set of rails and the transverse rails upon movement of the dolly from the first set of rails onto the transverse rails, and the second set of rail sections are pivotally mounted on the ends of the transverse rails adjacent the second set of rails and urged by spring means into an upright position, the second set of rail sections being movable by contact with the wheels of the dolly into a horizontal position bridging the gap between the transverse rails and the second set of rails upon movement of the dolly from the transverse rails onto the second set of rails.

3. A machine for vacuum-sealing a mass of cheese in an envelope of heat sealable plastics material which forms an internal lining in a cheese box mounted on a wheeled dolly, the envelope having an open end which projects out of the cheese box, the machine comprising a frame providing an upright wall having a sealing surface thereon, a hollow casing mounted on the frame for movement towards and away from said sealing surface on the wall, the casing being open at the end facing said wall and the casing being movable between an open position in which the casing is spaced from the wall and a closed position in which the open end of the casing abuts the sealing surface on the wall and cooperates therewith to define a closed chamber, latch means operable to clamp the casing to the wall to provide an air tight seal therebetween, support means mounted on said wall for support of the wheeled dolly and cheese box, the support means, wheeled dolly and cheese box being accommodated within said chamber when the casing is in the closed position, gripper mechanism mounted on said wall for holding open the open end of the envelope, first welding mechanism mounted on said wall, second welding mechanism mounted on the casing in the interior thereof and adapted to cooperate with the first welding mechanism to seal the open end of the envelope, said gripper mechanism and said first welding mechanism being mounted on a part of the wall which is surrounded by said sealing surface, and control valve means operable selectively to connect the chamber to a source of vacuum or to atmosphere, wherein said support means comprises a cantilever structure mounted on a part of the wall which is surrounded by said sealing surface and transverse rails mounted on the cantilever structure, the transverse rails being adapted to support the wheeled dolly with the wheels thereof in rolling engagement with the transverse rails, further rails are aligned with said transverse rails for rolling the dolly and cheese box onto and off said transverse rails when the casing is in the open position, and the casing comprises two side walls, a back wall, a roof, a floor, a ramp between the floor and the back wall, and a walkway which has one side thereof pivotally connected to said cantilever structure and the other side thereof supported on the floor of the casing, the arrangement being such that the walkway traverses along the floor of the casing, onto the ramp and then rides up the back wall into an upright position upon movement of the casing from its open position to its closed position.

* * * * *